US005603495A

United States Patent [19]

Noveck

[11] Patent Number: 5,603,495

[45] Date of Patent: Feb. 18, 1997

[54] BASKETBALL SHOOTING PRACTICE DEVICE AND METHOD OF TRAINING BASKETBALL SHOOTING

[76] Inventor: Ira Noveck, CREA, 1, rue Descartes, 75005 Paris, France

[21] Appl. No.: 553,865

[22] Filed: Nov. 6, 1995

[51] Int. Cl.[6] ..... A63B 69/00

[52] U.S. Cl. ..... 473/447; 273/392

[58] Field of Search ..... 273/1.5 R, 1.5 A, 273/392

[56] References Cited

U.S. PATENT DOCUMENTS

| | | | |
|---|---|---|---|
| 4,244,569 | 1/1981 | Wong | 273/392 X |
| 4,506,886 | 3/1985 | Lamb, Sr. | 273/1.5 A |
| 4,842,283 | 6/1989 | LeBel et al. | 273/392 |
| 4,915,381 | 4/1990 | Hackett | 273/1.5 A |
| 5,120,053 | 6/1992 | Head et al. | 273/1.5 R |

FOREIGN PATENT DOCUMENTS

| | | | |
|---|---|---|---|
| 1006504 | 10/1965 | United Kingdom | 273/1.5 R |

*Primary Examiner*—Paul E. Shapiro
*Attorney, Agent, or Firm*—Walter Scott

[57] ABSTRACT

A target practice device for improving an outside shot is mountable on any place on the rim of the basketball goal that has an available surface, i.e. any pan of the rim that does not also have a hook supporting the net. The target can be placed on the rim so that the target-face can be at various angles ranging from 90 degrees (with respect to the ground) to 0 degrees. The target is designed so that it will retract readily to the force of an incoming basketball. When the ball's trajectory is completed, the target returns to its equilibrium position. The device can be mounted on to, and without damaging or altering any part of, a standard basketball goal.

4 Claims, 8 Drawing Sheets

FIG. 10

When replacing the target with a smaller target, adjusting the height of the center of the target so that the center of the smaller target is substantially the same distance from the rim as the prior target was

FIG. 11

When replacing the target with a smaller target, adjusting the return means on the target so that the travel of the basketball through the hoop remains substantially constant despite changing the target size

FIG. 12

Providing the shooter in training with marks on the floor in front of the basket from which the shooter is to practice his shots

BASKETBALL SHOOTING PRACTICE DEVICE AND METHOD OF TRAINING BASKETBALL SHOOTING

BACKGROUND AND PRIOR ART

The invention relates to shooting practice devices, and the use of such devices, in the sport of basketball to improve the accuracy of a player's outside shot. More particularly, the present invention relates to basketball training devices that positively indicates to the shooter that a shot is properly on course.

The prior art describes two kinds of training devices. The first category of devices comprises those whose engagement provide negative feedback indicating an inaccurate shot (U.S. Pat. No. 4,206,915 to Woodcock and U.S. Pat. No. 5,354,048 to Winesberry, Jr.). The second category comprises devices whose engagement provide positive feedback indicating an accurate shot (U.S. Pat. No. 4,244,569 to Wong, U.S. Pat. No. 4,506,886 to Lamb Sr., U.S. Pat. No. 4,836,539 to Knapp, U.S. Pat. No. 4,915,381 to Hackett, and U.S. Pat. No. 5,390,912 to Silagy). The above-listed patents are hereby incorporated by reference.

The prior art positive-feedback devices can be considered targets. The device reported in the Knapp patent alters, i.e. enlarges, the perceived shape of the rim itself The device reported in the Silagy patent places the target below the rim and on the net. The devices reported in the Wong and the Hackett patents place the targets at rim-level. The device of the Lamb patent poises the target above the mouth of the rim.

As set forth in the Lamb patent, a target positioned above-the-rim provides the shooter with a clearer penultimate goal and can serve as a guide to the shooter who is charting the shot's trajectory. Only the Lamb device meets this criteria.

Lamb and others have suggested that in training basketball shooting, the shooter should imagine such a point in space and that the shooter should shoot at said point. The premise is that if the shooter can hit his imaginary point in space, he will put the basketball in the hoop with greater accuracy.

Targets placed at-, or below-, rim-level, such as those reported in the Knapp, Silagy, Wong and Hackett patents, can not train the shooter as well. First, in some instances, the net will obscure targets positioned at-, or below-, rim-level. Second, success with targets that are at-, or below-, rim-level does not necessarily entail the use of the target (i.e., the basketball reaches the target after reaching the net which itself indicates that the shot was successful), and not as an indicator that the shot is on course.

Notwithstanding these advantages of the design set forth in the Lamb patent, the Lamb patent device requires an elaborate apparatus which must be customized to a backboard. Thus, there is a need for an above-the-rim basketball training device that is readily attached, and detached, without requiring a customized backboard, and which training device does not adversely affect the use of the backboard and hoop in gamelike conditions. Furthermore, Lamb reports that his device is designed to train specific arcing shots, and thus, the Lamb device does not aid the shooter who wishes to improve a relatively flat shot.

SUMMARY OF THE INVENTION

The target of the present device is an above-the-rim target. It is believed that by aiming for a point in space above-the-rim, a shooter improves his/her accuracy. Furthermore, it is believed that an above-the-rim target will aid the shooter in envisioning a target after the target device has been removed. Desirably, the target of the present invention is used in training outside shooting, but it need not be limited to such uses.

The present invention provides a basketball target that sits atop an ordinary basketball rim as a clear and obvious mark. The invention provides an actual target so that a shooter can focus on a point in space as he aims at the basket. In a preferred embodiment, the inventive target gives way to an incoming basketball and returns to position after a basketball hitting the target travels through its course.

Furthermore, the target of the present invention can be easily attached and detached to any preexisting rim without damaging, altering, or replacing any part of the basketball goal or backboard. Additionally, a single basketball rim can accommodate more than one target of the present invention. Thus, two or more shooters can use different targets on the same rim at a given time and the placement of the target can be optimized for right and left sided shots as well as for individual shooters. Similarly, the target of the present invention can be mounted on any part of the rim, thereby aiding practice shots from nearly any angle on the court.

The present invention provides a means of varying the target sizes from large to small. This variation permits the trainer to aid the shooter in making the transition from a real target to an imaginary one.

Yet another way that the present invention can aid individualized training is by varying the angle of the target to the plain of the rim. When the target is placed at an angle of about 90° relative to the plain of the rim, the angle is optimized to train relatively flat (line-drive) shots while a substantially smaller angle is useful for training classic high-arched shots. Thus, the present invention can accommodate a variety of shooting styles.

Finally, the target can remain in place during game conditions.

BRIEF DESCRIPTION OF THE DRAWINGS

FIG. 10 is a flow chart step of an optional step in the flow chart of FIG. 9;

FIG. 11 is a flow chart step of an optional step in the flow chart of FIG. 9; and FIG. 12 is a flow chart step of an optional step in the flow chart of FIG. 9.

DETAILED DESCRIPTION

Figure 1:
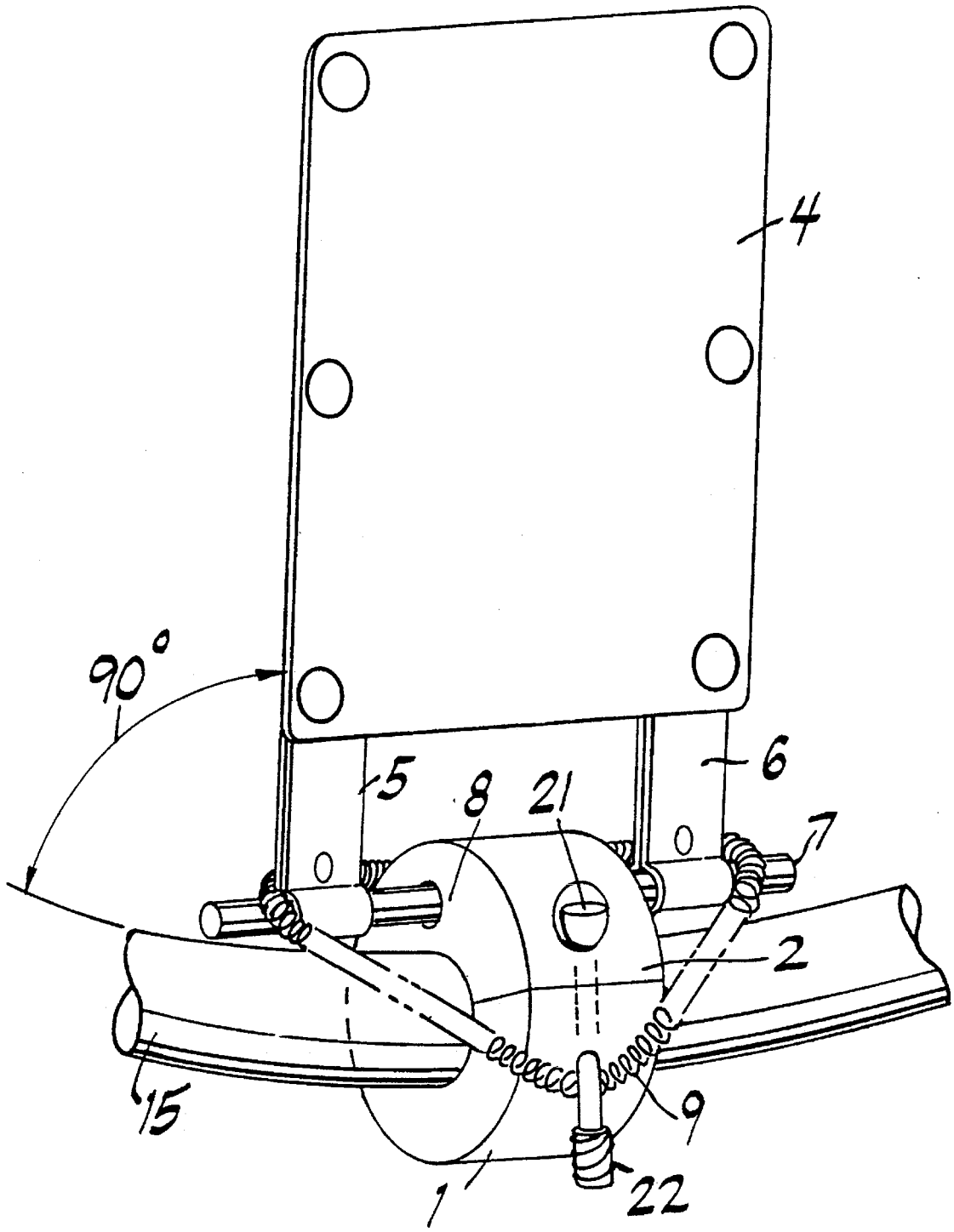
FIG. 1 is a frontal view of the target sitting atop the rim at 90° to the plain of the rim.

The overall construction of a preferred embodiment of the present invention is shown in FIG. 1. This figure shows the embodiment mounted on the rim 15 of a basketball hoop. This embodiment consists of a clamping means 1 tbrmed by two collars 2 and 3, a mounting means, in this embodiment includes rod 7, which in this embodiment is connected to the upper collar of the clamping means through an aperture 8, and then to a connecting means. The connecting means may comprise one or more arms, for example, in the illustrated embodiment, consists of two supportive arms 5 and 6 that connect 1) the mounting means, a target means (or face) 4, 2) the connecting means and 3) a return means. In this embodiment, the return means comprises of a spring 9.

Alternatively, the return means can be formulated from other conventional materials, especially elastic materials such as rubber, latex and the like.

The return means of the target device gives way to an incoming basketball and springs back into place aPter the basketball travels its proper course through the target. Desirably, the return mechanism provides minimal resistance to the incoming basketball so as to not change the course of travel of the basketball.

Figure 3:
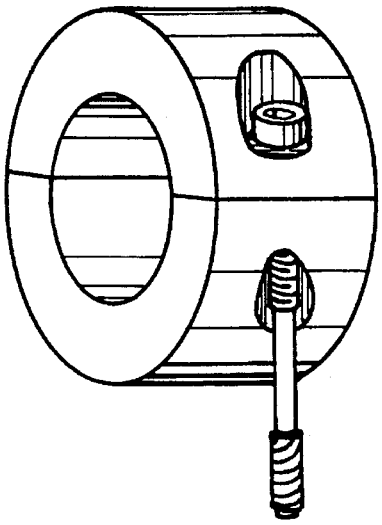
FIG. 3 is a side view showing an embodiment of the clamping means in an open position.
Figure 4:
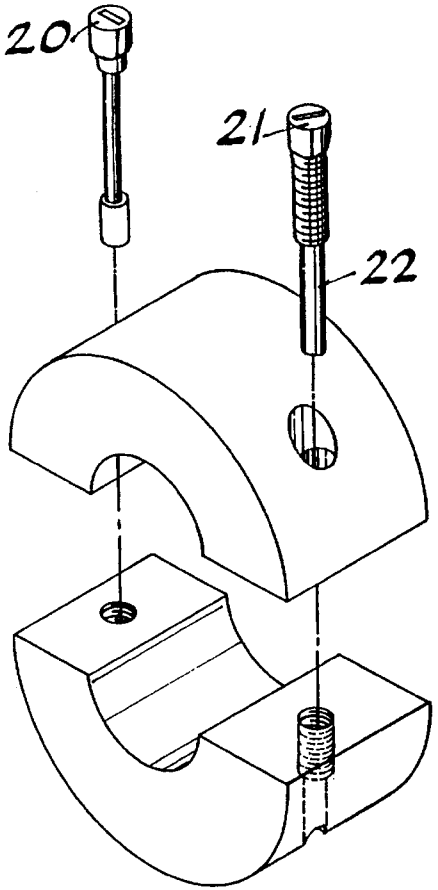
FIG. 4 is a side view showing an embodiment of the clamping means in a closed position.
Figure 7:
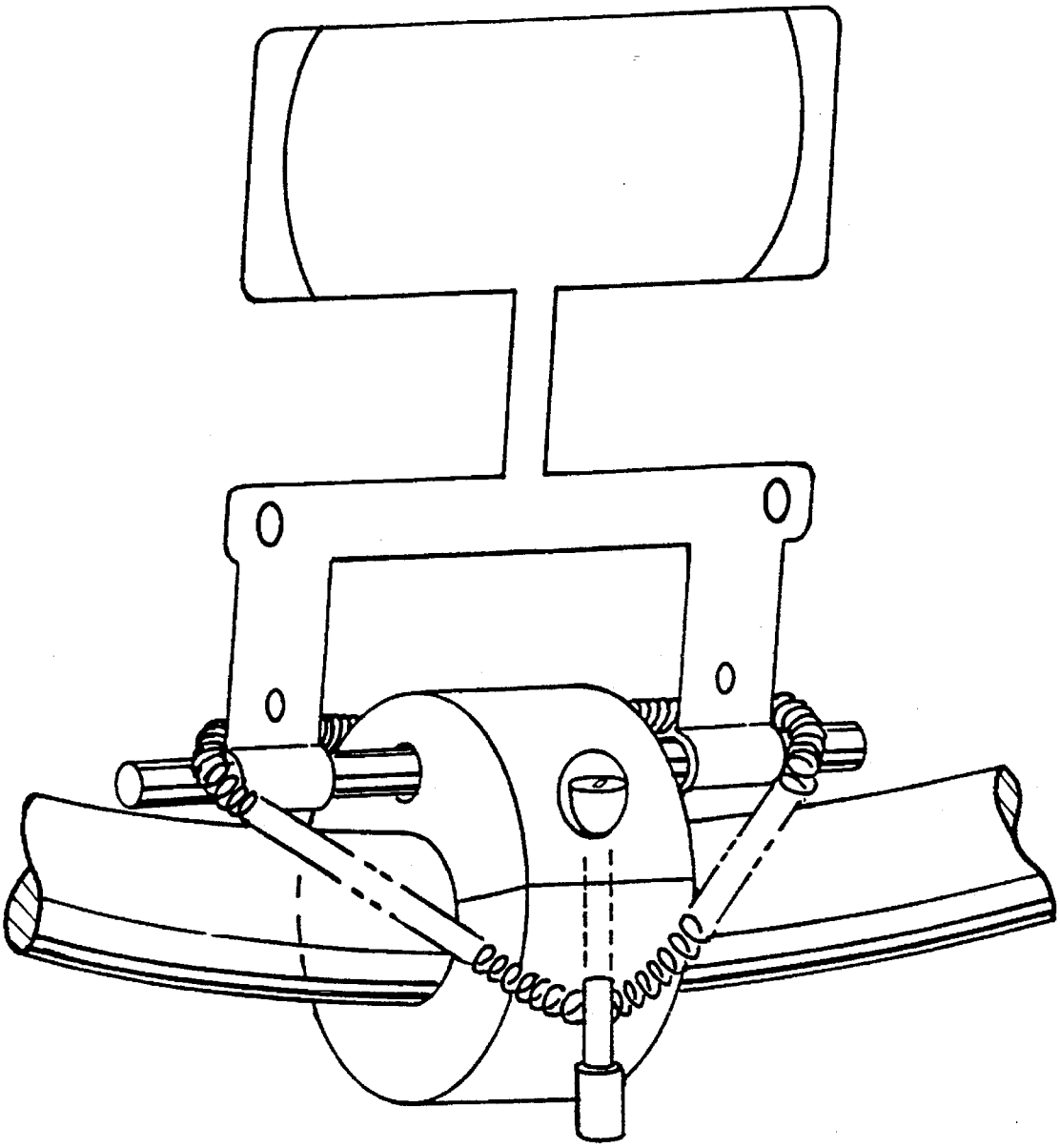
FIG. 7 is a frontal view of an alternative embodiment of the target means sitting atop the rim at 90° to the plain of the rim.

The target is joined to the basketball rim by one or more clamp means. A preferred clamp means is illustrated in FIGS. 3 and 4. This preferred clamp means is typically made from conventional materials including metals and other solid materials such as steel, or from resilient material, e.g., urethane. In this preferred embodiment, the clamp means is made of two pieces that fit together to form a cylindrical collar. For example, half-moon shaped metal collars that are fastened into one another with two screws at 20 and 21 can be employed as the clamping means. The shorter screw is optional for it is designed to fasten the clamp to the rim more securely. Desirably, the clamp's interior circumference is substantially the same as, or slightly smaller than, the rim's outer circumference.

In an alternative embodiment, the clamp means comprises a sleeve made from at least one piece or comprises two, or more, hinged pieces that clamp about the rim; a locking means, such as a screw, lock or latch to secure the clamp means to the hoop rim, and desirably; a means of anchoring, or stabilizing, the return means.

The clamp means can be attached to any pan of the rim that has space for it, i.e., on any portion of the rim not covered by the hooks that hold a net. Thus, it is desirable that the width of the clamping means is less than the distance between the hooks that hold the net. It is more desirable that the width of the clamping means is between about 0.25 and about 1 inches (0.65 to 2.5 cm).

The target is designed to be a factor before the ball drops into (or towards) the basket. Thus, the target is most useful along the top of the rim between a shooter and the mouth of the basket. While the target of the present invention can usefully be positioned at any point on the rim, it is desirable that the target is not mounted on the back of the rim.

An important aspect of the preferred spring return means embodiment is the anchor on the clamp means. For instance, in the illustrated embodiment, the anchor can be a protrusion of the clamp's front-most screw beyond the exterior of the collar (see, for example, FIGS. 3 and 4). The elongated screw 21 in this embodiment thus serves a dual purpose: 1) it secures the clamp means to the rim, and 2) its protruded end 22 anchors the return means, e.g., a spring or a rubber band 9.

Figure 2:
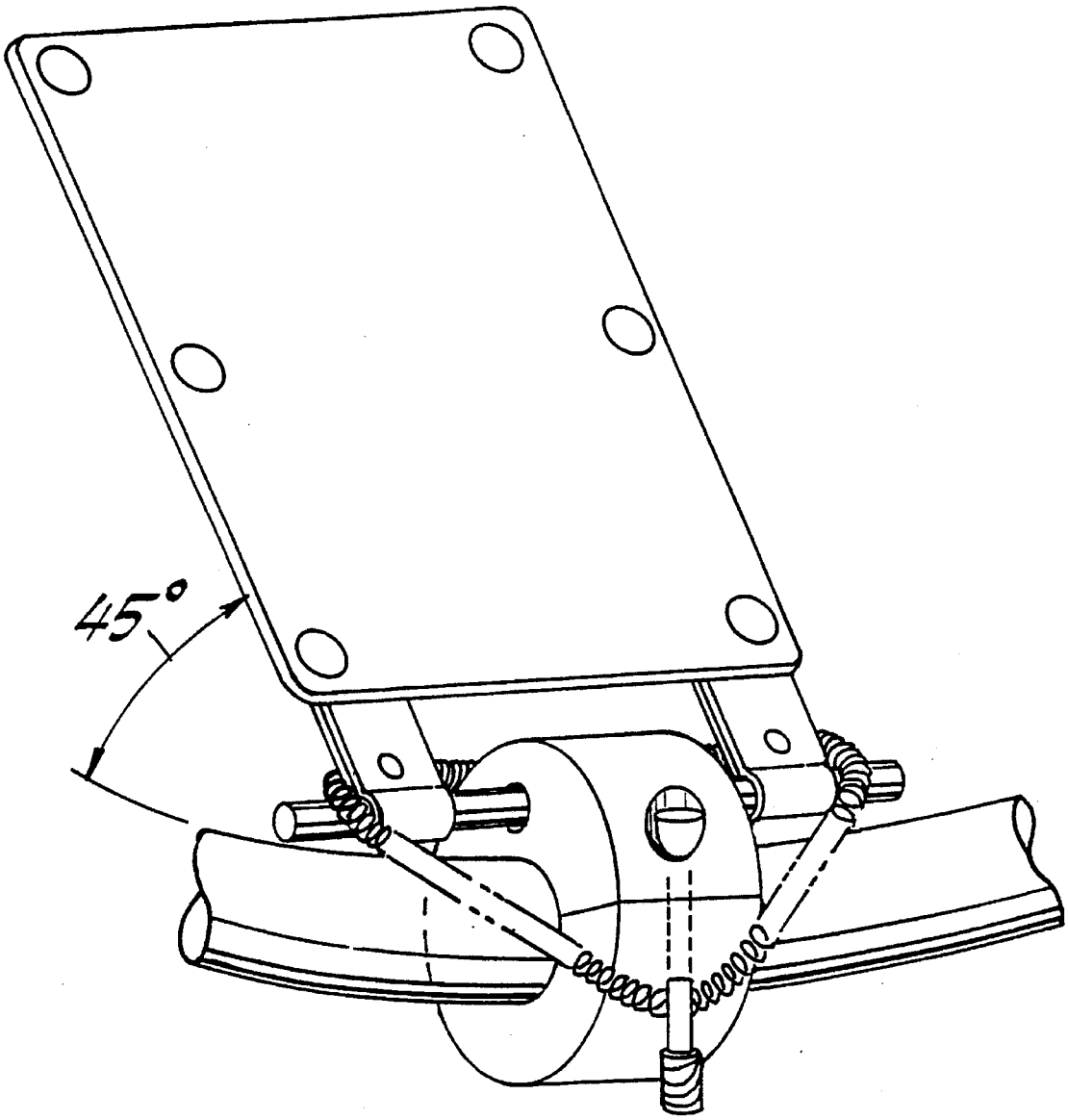
FIG. 2 is a frontal view of the target sitting atop the rim at 45° to the plain of the rim.

The clamp means, and therefore, the target, can be mounted at numerous angles with respect to the plane of the rim (and consequently, the ground). For example, one can mount the clamp means so that the target will be at an angle of 90 degrees relative to the ground (as in FIG. 1) or one can mount the target so that the target is at an angle of 45 degrees relative to the ground (as in FIG. 2). The advantage of the multiple angles is that the target can accommodate many styles of shot. A line drive (horizontal) shot benefits from a target that is poised straight up (as in FIG. 1) and a classic arched shot benefits from the target poised at a less-than-straight angle (as in FIG. 2).

Figure 6:
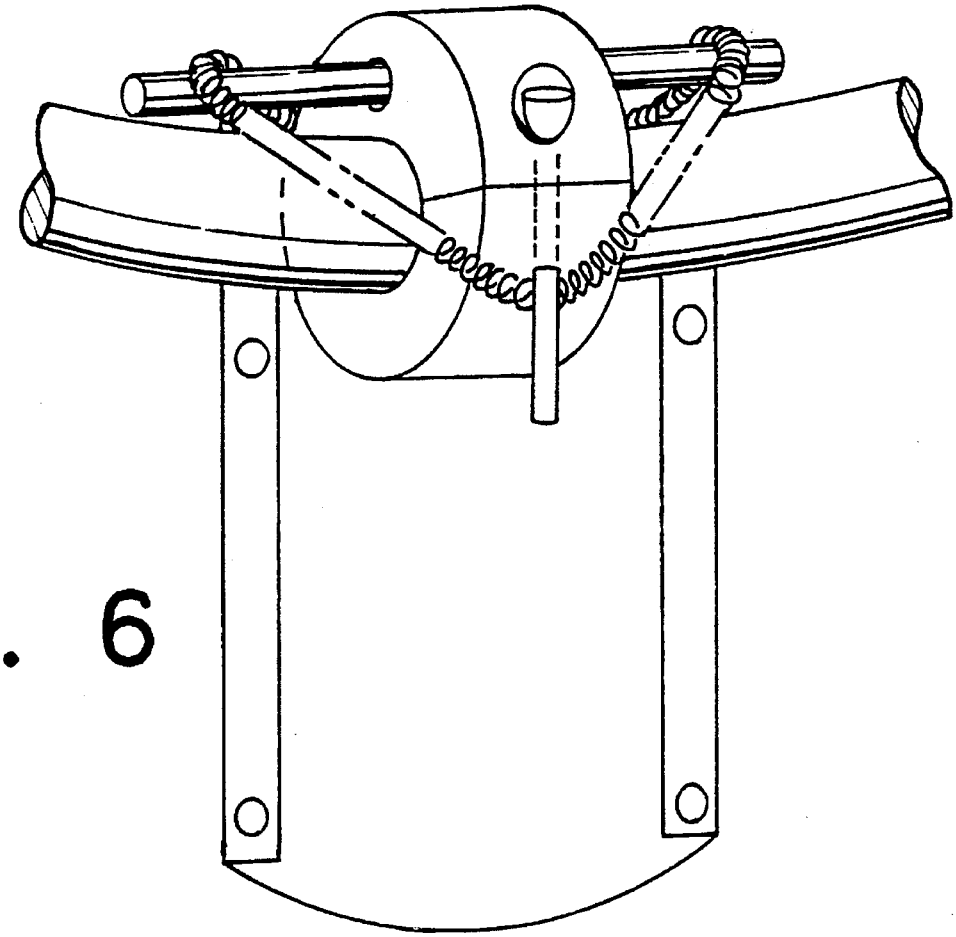
FIG. 6 is a close-up front view of the target in its immediately post-shot position.
Figure 5:
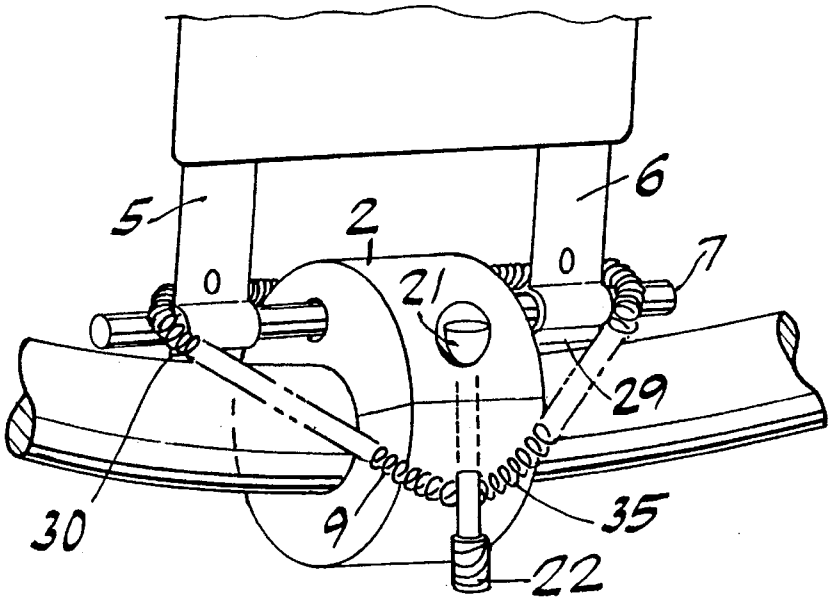
FIG. 5 is a close-up front view of the target in pre-shot position.

The mounting means can be any conventional means of attaching a movable piece to a stationary piece. In the preferred embodiment illustrated in FIG. 1, the mounting means, rod 7, holds the target means and is fitted through an aperture 8 in the upper half of the collar. Typically, rod 7 is between about 1 and about 4.5 inches (2.5 and 11.3 cm). When the target means is hit by an incoming basketball, the target means moves out of the way of the basketball and desirably makes as minimal an impact as possible on the momentum of the incoming basketball. For instance, the target means may be propelled backwards by the force of an incoming basketball causing the target means to rotate backwards (see FIG. 6). It is further desired in this embodiment of the present invert/lion that the target means rests with its base touching the rim (see 29 and 30 in FIG. 5). In a particularly preferred embodiment, the target means uses the rim to limit the target means' forward travel while the return means concurrently pushes the target means forward.

The spring embodiment of the return means (see 9 in FIG. 1), is desirably made from metal or an elastic material such as rubber or latex. In the illustrated embodiment, the spring return means, fits over the target means so that the return means wraps around the target means' back, extending outward from the two sides of the target means, swaddles the front of the rim, and is attached to the anchor means on the clamp means. In this embodiment, the spring return means assures that the target returns to its original position and keeps the target poised in an upward position when the device is at rest. The length of the spring is determined by the size of the target face.

The target face is typically supported by one or more arms, and in the illustrated embodiment, the target face is supported by two flat arms 5 and 6, which are each attached to the mounting means, i.e., near the two ends of the illustrated rod mounting means. The target face is usually attached to the two arms by any conventional fastening means, such as rivets, screws, adhesive, and nuts and bolts.

The target face can be of many different sizes, typically ranging from about 1 square inch (e.g., 1 in×1 in, 2.5 cm×2.5 cm) to about 16 square inches (e.g., 4 in×4 in, 10 cm×10 cm). It is preferred that the target face is between about 1 and about 9 square inches (6.3 and 56 $cm^2$). A useful target face size is an about 2 by 3.5 inches (5×7.5 cm). In its preferred embodiment, the target face is replaceable by differently-sized target thces, such as a 9, a 4 and a 1 square inch target. It is also desired that the target is made of a resilient material. Moreover, the target face desirably fits into the goal, or mouth of the basket.

Figure 8:
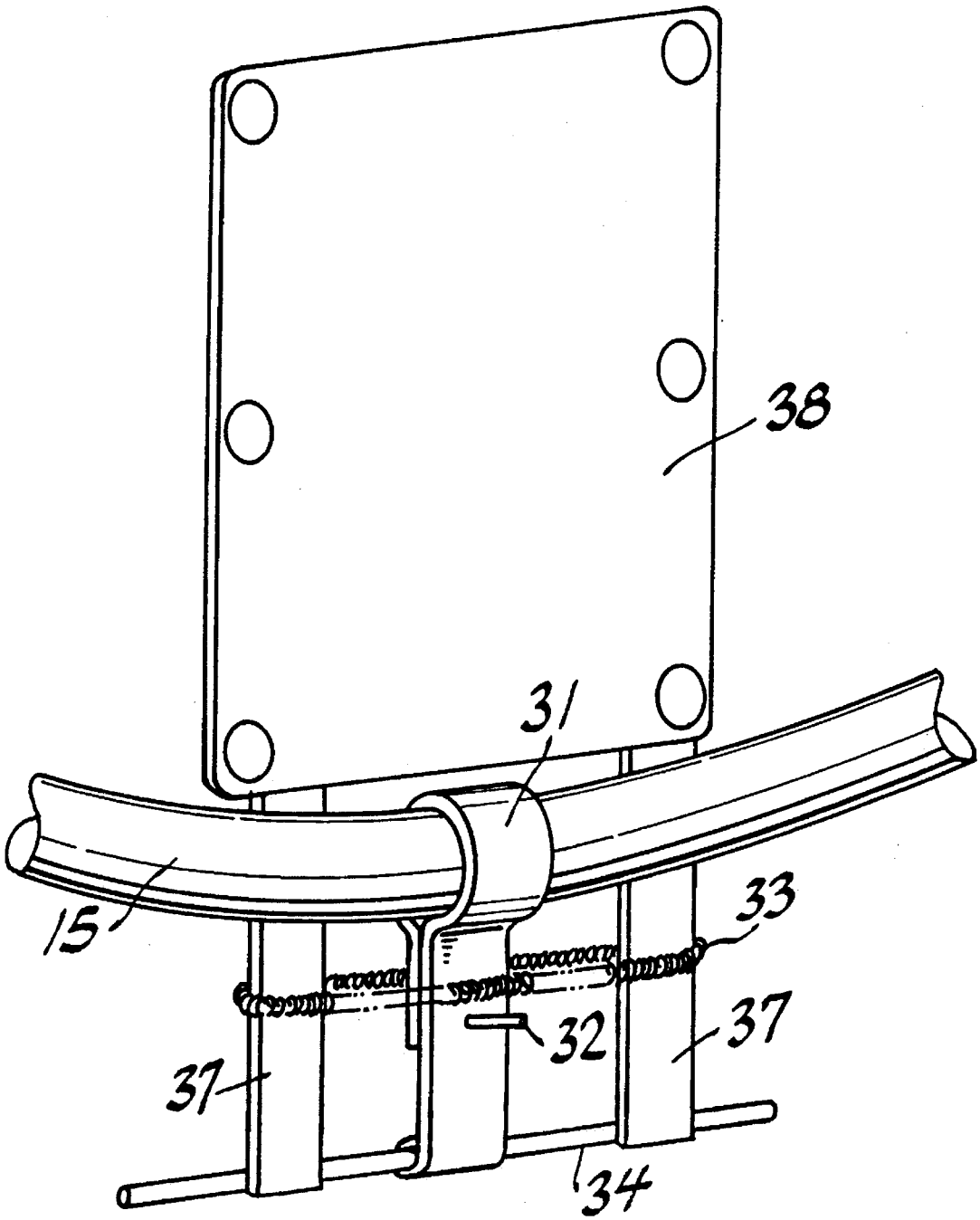
FIG. 8 is a frontal view of another alternative embodiment of the target means sitting atop the rim at 90° to the plain of the rim.
Figure 9:
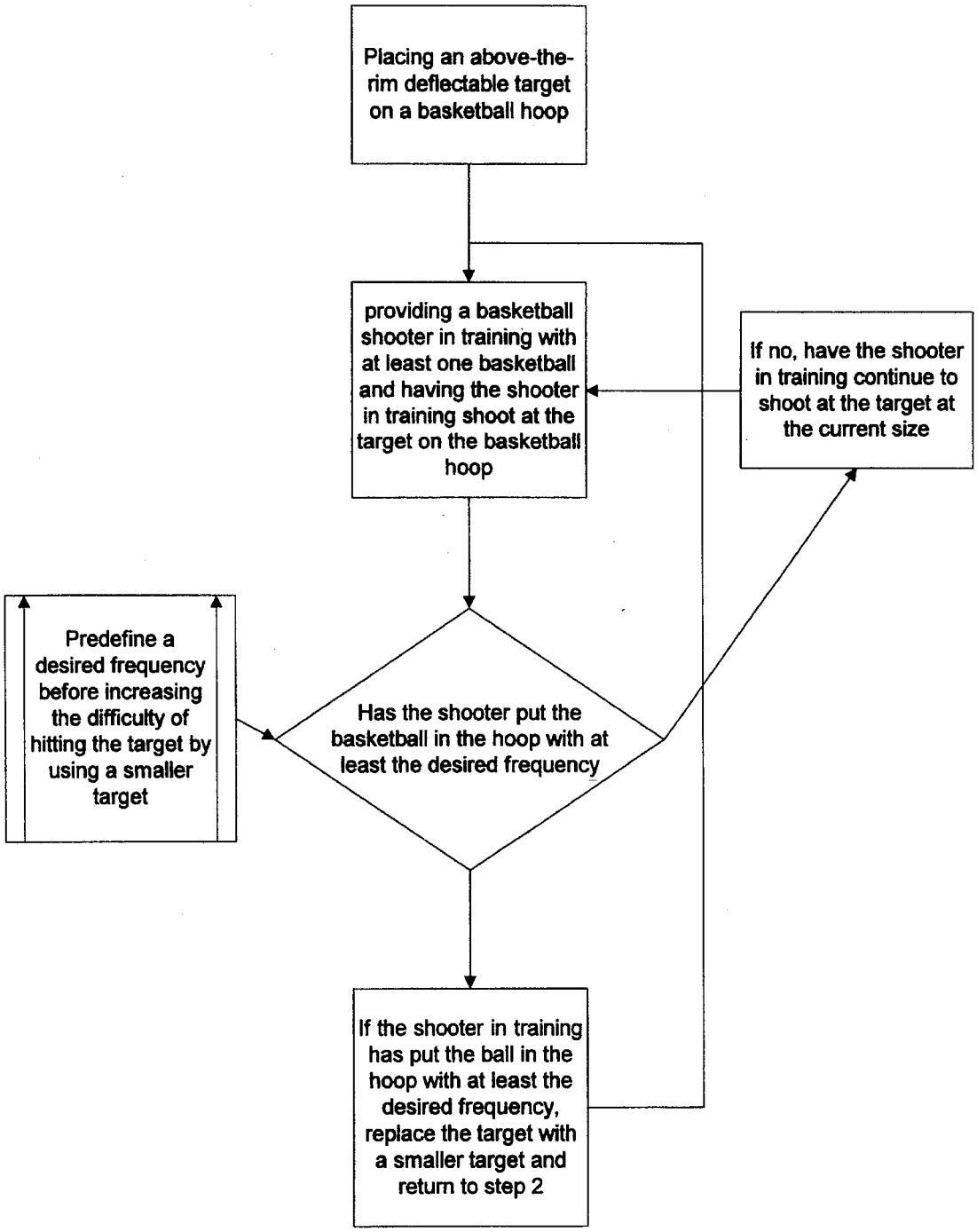
FIG. 9 is a flow chart of a desirable embodiment of the training method of the present invention.

Another preferred embodiment of the present invention is illustrated in FIG. 8. In that embodiment, clamping means 31 detachably attaches to rim 15 of a basketball hoop. In one version of this embodiment, clamping means 31 is secured on rim 15 by fastening device 32, which can be any conventional fastening device such as a screw, clasp and the like. Desirably, clamping means 31 also has a protrusion that restrains the return means 33 from falling off of the training device. The protrusion may be an extended screw fastening device or it may be a separate structural feature of the clamping means. Additionally, clamping means 31 also has a means of attaching a mounting means 34 which is desirably secured to the clamping means by any conventional means including O-rings, threads, a securing screw and the like. The target face 38 is rotatably attached to the mounting means via connecting means 37.

A desirable method of training a person to shoot a basketball uses target faces of several sizes. More desirably, the training method uses at least three different size target faces. Initially, the training device of the present invention is mounted on the rim of a basketball hoop using the largest target face. The person being trained is asked to shoot the basketball from a set position, say the foul line, for a number of shots, for example 100. The number of times the shooter hits the target out of that 100 shots is recorded which determines the shooter's accuracy in shooting the basketball from that position. If the shooter's accuracy is equal to, or greater than, a predetermined value, say 75 percent, the target face is replaced by a slightly smaller target face. If the shooter's accuracy is less than the predetermined value, then the shooter is asked to shoot another round of say 100 baskets and the shooter's accuracy is again determined. If the accuracy is equal to, or greater than, the predetermined value, then a smaller target face is substituted for that which had been used. This process is repeated until the shooter has achieved the desired accuracy with the smallest target face. At that time, all target faces are removed and the shooter is asked to continue to shoot, but to only imagine that the target is there above the rim. Desirably, when a new training session begins, the shooter starts with the target face on which he last achieved the predetermined accuracy. Thus, if the shooter had the predetermined accuracy with the second largest target face during the last training session and had progressed to the third largest target face (without reaching the predetermined accuracy) in that last training session, the shooter would begin the new session with the second largest target face and would only return to the third largest target face when he had again achieved the predetermined accuracy with the second largest target face.

When the shooter is able to shoot the basketball with the desired accuracy from the first training position, without the target device, the shooter is moved to a new shooting position, such as the position halfway between the foul line and the right corner of the court (relative to a person at the foul line looking at the nearest basket). In this new position, the training process is repeated using a large target face followed by progressively smaller target faces until the desired accuracy is achieved. At that point, the shooter is trained from a new position using the training method of the present invention.

Additionally, the target device of the present method of the present invention can be used to "refresh" a shooter's skills in substantially the same manner, but typically with substantially fewer shoots being used with each size target face.

It is further preferred that the center, or bullseye, of each of the target faces is located substantially the same distance from the rim of the hoop.

In the rod mounting means embodiment, the length of the rod is adaptable. A relatively short mounting means can accommodate a small target while a longer mounting means can accommodate small and wide targets.

In a preferred embodiment of the rod mounting means of the present invention, the clamping means further comprises a means for securing the rod such as a screw. It is further preferred that the rod in this embodiment has a flattened position to further enable the screw to secure the rod and prevent the rod from rotating in the clamp. In other embodiments, the rod may be secured by washers or o-rings on one, or both, sides of the aperture.

In an alternative embodiment of the present invention, when an incoming basketball makes contact with the target means, the target device actively moves the target face out of the path of the basketball until the ball has passed the position of the target face. For example, contact with the target means activates a means for moving the target out of the position and, after the lapse of a predetermined time, returns the target face to the original position.

What I claim is:

1. A method of training a basketball shooter comprising:

a) providing said shooter with an above-the-rim target that deflects when the shooter hits the target; and b) when said shooter hits said target with a preselected frequency, replacing said target with a smaller target.

2. The method of claim 1 in which the center of said smaller target is located substantially the same distance from the rim that the center of the initial target was located.

3. The method of claim 1 in which a return means is adjusted to compensate for the change in the size of the target.

4. The method of claim 1 in which said shooter stands on a floor in front of a hoop upon which said target is mounted, and said shooter is provided with more than one mark on the floor in front of the basketball hoop from which to train.

* * * * *